US006533066B1

(12) United States Patent
O'Dell

(10) Patent No.: US 6,533,066 B1
(45) Date of Patent: Mar. 18, 2003

(54) LANYARD WITH INTEGRAL FALL ARREST ENERGY ABSORBER

(75) Inventor: David Ray O'Dell, Thornton, CO (US)

(73) Assignee: Rose Manufacturing Company, Englewood, CO (US)

( * ) Notice: Subject to any disclaimer, the term of this patent is extended or adjusted under 35 U.S.C. 154(b) by 0 days.

(21) Appl. No.: 09/687,174

(22) Filed: Oct. 13, 2000

Related U.S. Application Data

(60) Provisional application No. 60/159,300, filed on Oct. 14, 1999.

(51) Int. Cl.[7] ..... A47L 3/04

(52) U.S. Cl. ..... 182/3; 182/4; 182/5; 188/371

(58) Field of Search ..... 182/3, 4, 5, 6, 182/7, 8, 18; 188/371; 297/472

(56) References Cited

U.S. PATENT DOCUMENTS

| | | | | |
|---|---|---|---|---|
| 4,253,544 A | | 3/1981 | Dalmaso | 182/3 |
| 4,493,466 A | | 1/1985 | Trenholm et al. | 244/152 |
| 4,618,026 A | | 10/1986 | Olson | 182/4 |
| 4,634,625 A | | 1/1987 | Franklin | 428/258 |
| 5,090,503 A | | 2/1992 | Bell | 182/5 |
| 5,207,363 A | | 5/1993 | Duchi, Jr. et al. | 224/255 |
| 5,287,943 A | | 2/1994 | Bell | 182/3 |
| RE35,028 E | | 8/1995 | Casebolt et al. | 119/857 |
| 5,506,043 A | * | 4/1996 | Lilani | 428/229 |
| 5,555,716 A | | 9/1996 | Dugan | 57/224 |
| 5,598,900 A | | 2/1997 | O'Rourke | 182/3 |
| 5,660,804 A | | 8/1997 | Ochi et al. | 428/373 |
| 5,795,835 A | | 8/1998 | Bruner et al. | 442/310 |
| 5,806,732 A | | 9/1998 | Hensley | 224/258 |
| 5,843,158 A | * | 12/1998 | Lenker et al. | 623/1 |
| 5,844,860 A | * | 12/1998 | Miller | 367/154 |
| 6,036,068 A | * | 3/2000 | Cartmell | 224/258 |
| 6,037,421 A | * | 3/2000 | Asrar | 525/420 |
| 6,085,802 A | * | 7/2000 | Silberberg | 139/387 R |
| 6,390,234 B1 | * | 5/2002 | Boyer | 182/3 |

* cited by examiner

*Primary Examiner*—Bruce A. Lev
(74) *Attorney, Agent, or Firm*—James G. Uber, Esq.; Douglas R. Hanscom, Esq.

(57) ABSTRACT

A shock absorbing lanyard having an integral fall arrest energy absorber formed in a one-piece woven, knitted or braided construction wherein partially oriented yarn ("POY") fibers and high modulus yarn fibers are combined integrally in one section and are separate in another section in which the high modulus yarn fibers preferably form a sheath around a core of POY fibers.

16 Claims, 8 Drawing Sheets

LANYARD WITH INTEGRAL FALL ARREST ENERGY ABSORBER

This application claims the benefit of Provisional Application No. 60/159,300, filed Oct. 14, 1999.

FIELD OF THE INVENTION

The present invention relates generally to fall protection equipment and more particularly to a shock absorbing lanyard having a fall arrest energy absorber formed integrally therewith.

BACKGROUND OF THE INVENTION

Under normal working conditions, a worker, when working on a scaffold, catwalk or other locations that are at a relatively high place from where a fall could result in serious injury, will wear some type of safety harness. Typically, the safety harness is attached to a lanyard, which in turn is attached to an anchorage point. Various lanyards have been developed in order to provide the necessary resistance to decelerate a worker's fall.

One such device is illustrated in U.S. Pat. No. 4,618,026 which shows a shock absorbing lanyard having overlaying or superposed sections of webbing which are stitched together and are pulled over a separating means by a force applied thereto during a fall so that successive portions of the superposed sections are separated thereby generating a counteracting force to a fall.

Another type of shock absorbing lanyard is illustrated in U.S. Pat. No. 4,253,544 wherein a tensile load bearing woven core is surrounded by a jacket. The jacket is longer than the woven core and the excess material is bunched or gathered accordion style at one end of the lanyard. An indicator flag is affixed to the gathered section and is released when a suitable load causes the gathered section to stretch.

It would be desirable, therefore, to have a shock-absorbing lanyard formed integrally from one piece of webbing without a woven core since the woven core reduces the energy-absorbing capacity of the lanyard.

SUMMARY OF THE INVENTION

Generally, the present invention provides a shock absorbing lanyard utilizing a one-piece webbing construction wherein partially oriented yarn ("POY") fibers and high-strength yarn fibers are assembled integrally in a first section and assembled separately in a second section. Preferably, the second section is tubular in shape such that the high-strength yarn fibers form a sheath around a core of POY fibers. It is not necessary for the sheath to totally encapsulate the POY fibers, even though this is a preferred embodiment since it protects the POY fibers from wear and weathering. Moreover, the sheath does not necessarily need to be tubular in shape, but simply any grouping of yarns intended for residual strength once the POY fibers reach their designed elongation. The POY fibers provide an energy-absorbing feature by elongating under force. The POY fibers may be nylon, polyester or polypropylene or the like or any combination thereof. The high-strength yarn fibers may be nylon, polyester or aramid or the like or any combination thereof.

The POY fibers and the high-strength yarn fibers are preferably assembled in the integral first section in a one-piece webbing construction by weaving, knitting, braiding or the like. The integral first section locks in the POY fibers relative to the second section which can elongate under force. The high-strength yarn fibers of the sheath are preferably formed into an abrasion resistant weave. Preferably, a section of the sheath is doubled over on itself about a section of the core in order to accommodate elongation of the POY fibers in the core. Alternatively, the sheath may be bunched or gathered accordion style about the core. Preferably, a rip stitch through both the sheath and core in or beside the overlapped section is used to secure the overlapped section.

The sheath need not be overlapped if the residual strength ends (i.e., the high-strength yarn fibers) are set long in the integral first section with respect to the energy-absorbing ends (i.e., the POY fibers). This can be accomplished by forming loops with the residual strength ends of a woven material such as is found in the pile structure of towels or Velcro fasteners. In a knitted webbing, this can be accomplished by knitting the residual strength ends and inlaying the energy-absorbing ends or knitting them with minimal laps. Finally, a braided structure can be formed without a need for overlapping if the energy-absorbing ends are inserted as a core to a circular braid. One could also insert the energy-absorbing ends as the straight ends of a triaxial braid.

The knitted and braided web constructions provide the advantage of simplifying the lanyard assembly. Not only is the overlap step bypassed, but also material usage per lanyard need not be predetermined. Unfortunately, both of these advantages are accompanied by reduced material performance. Without the overlap step, the snag and abrasion resistance of the webbing is reduced since the residual strength ends are loose within the material. Further, if the webbing is formed with small interlace/non-interlace repeat sections so as to avoid predetermined lanyard sections, the performance the of energy-absorbing ends is reduced. This is due directly to the frequent interlacements, which reduce the peak elongation possible. The interlacements also reduce the material strength, especially in knit structures where there is knotting. Further, as the energy-absorbing ends elongate during deployment, friction at the interlacements encourages premature failure of the ends.

Included with the POY fibers may be some high strength or high modulus yarns to set or help set the activation force of the lanyard. High modulus yarns also help to increase the initial deployment forces by bringing the stress strain response of the lanyard closer to the ideal of a constant force. High initial forces also help reduce the deployment distance of the lanyard, which is generally desirable.

The energy-absorbing ends may be a mixture of many material types with the POY fibers. By blending POY fibers of different stress versus strain responses, an improved lanyard stress versus strain response can be achieved. Elastic may also be used in the energy-absorbing ends in order to minimize lanyard length when under low tension. Further, these energy-absorbing ends may have different lengths in the lanyard. This is another way to improve the lanyard stress versus strain response.

The webbing of the present invention can also be used as a component of a harness, self-retracting lifeline, horizontal lifeline, vertical lifeline, or other fall arrest devices.

BRIEF DESCRIPTION OF THE DRAWINGS

The present invention and its presently preferred embodiments will be better understood by way of reference to the detailed disclosure herebelow and to the accompanying drawings, wherein.

DETAILED DESCRIPTION OF THE INVENTION

Figure 1:
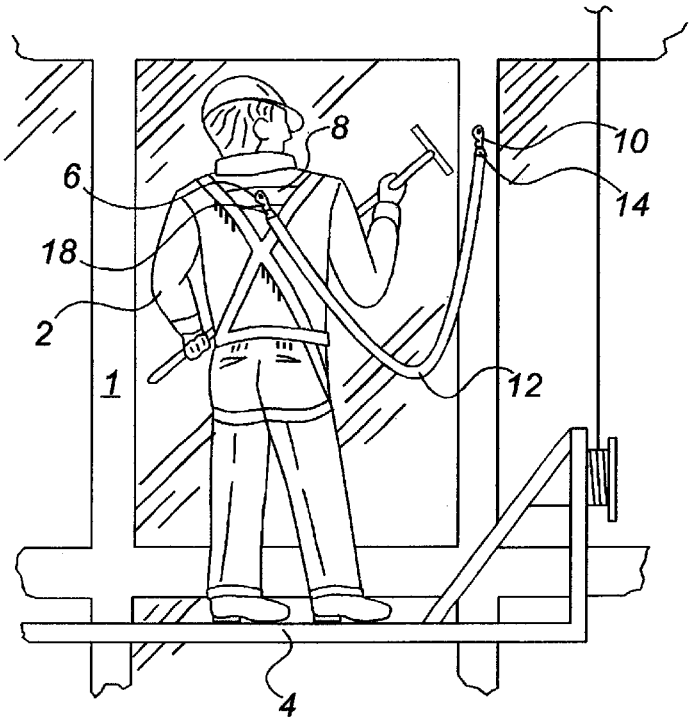
FIG. 1 shows a lanyard of the present invention in use.
Figure 2:
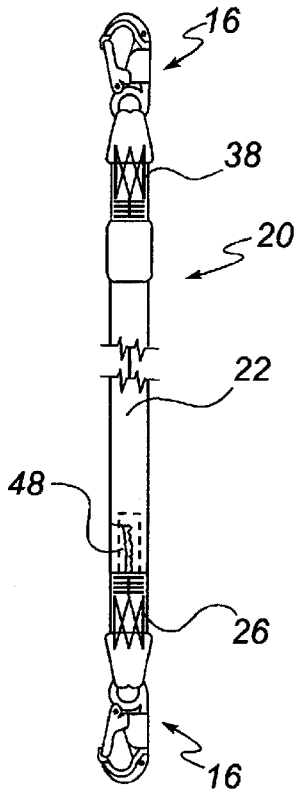
FIG. 2 shows a lanyard of the present invention including a warning label.

In FIG. 1, there is illustrated one use of the present invention. A worker 2 standing on a scaffold 4 is provided with a safety harness 6 having a hook 8. An anchor 10 is provided on a building 1 and a shock absorbing lanyard 12 has one end 14 secured to the anchor 10 and the other end 18 secured to the hook 8. Alternatively, either end 14 or 18 of the lanyard 12 may be secured either to the hook 8 or the anchor 10.

In FIGS. 2–5, there is illustrated a preferred embodiment of the shock absorbing lanyard 20 of the present invention. The lanyard 20 is constructed from a single piece of webbing including a sheath 22 formed of high-strength, fully oriented yarn fibers 34 surrounding a core 24 formed of POY fibers 36. At one end 26 of the lanyard 20, the fully oriented yarn fibers 34 and POY fibers 36 are preferably integrally woven together in a flat weave first section 28 and then woven separately in a tubular weave section 32 having a distinct core 24 of POY fibers and a sheath 22 of high strength yarn fibers. Alternatively, the first section 28 may also be tubular instead of a flat weave. In order to accommodate the elongation of the POY fibers in the core 24, the core 24 is trimmed at the opposite end 38, such that the sheath 22 is longer than the core by a predetermined length. The extra length of the sheath 22 is preferably folded back twice around itself (See FIGS. 3 and 4) and secured by a rip stitch 40 to form an overlapping sheath 42.

As shown in FIGS. 23–25, high modulus ends 44 are preferably but not necessarily woven among the POY fibers 36 to provide a minimum activation/deployment force so that the POY fibers do not elongate before required. If included, the high modulus ends 44 are integrally woven with the sheath 22 and core 24 in a high modulus binder section 46, shown in FIG. 5. Further, the rip stitch 40 on the overlapping sheath 42 also provides additional deployment strength such that when a sufficient tensile force is applied to the lanyard 20, the rip stitch 40 will break thereby allowing the POY fibers 36 to expand within the sheath 22 and absorb some of the energy of the fall.

Preferably, the lanyard 20 of the present invention will resist no less than 450 lb., and no more than 900 lb. before deployment. In this manner, the forces caused by normal use will not extend the POY fibers 36. Moreover, the high modulus ends 44 and rip stitch 40 also contribute to fall-arrest by exerting forces over the initial elongation range when the forces from the POY fibers 36 are low. This creates a force versus elongation response for the lanyard, which more closely follows the ideal response of a constant force over the designed elongation range. For example, with a lanyard that is allowed to elongate 42 inches to arrest the fall of a 220 lb. rigid weight after a 6-foot free fall at sea level, the ideal force versus elongation response is a constant 597 lb. force. This is the lowest peak fall-arrest force possible for the described scenario. The preferred construction is a lanyard 20, with snap hook fasteners 16 on either end, of a 6 foot fixed length from bearing point to bearing point. In such a construction, the excess sheath material and thus the amount of POY fibers 36 removed from the webbing measures 23 inches. Due to the designed fall arrest distance of 23 inches, the lowest possible peak fall-arrest force for the stopping of a 220 lb. rigid weight after a 6-foot free fall, is 909 lb.

Preferably a light sheath construction is utilized in the present invention to reduce the likelihood of high forces when the sheath is engaged for final fall arrest. This illustrates a further advantage of the sleek overlap design over the bunched design because the bunched design is prone to have abrasion problems and to snag, and therefore requires a heavier sheath construction than does the sleek overlap design.

While the rip stitch 40 on the overlapping sheath portion serves to clearly indicate deployment, an indicator flag 48

(See FIGS. 2 and 10) is also preferably sewn to one end of the lanyard and tucked within the overlapping sheath 42 to be tacked in by the above mentioned rip stitch 40. When the overlapping sheath 42 becomes extended during a fall, the exposed indicator flag 48 will signal that the lanyard 20 should not be reused.

The integral weave section 28 and the opposite end 38 of the extra length of the sheath 22 each are preferably passed through conventional hook fasteners 16, doubled over and stitched. It should be appreciated, however, that the lanyard 20 may be affixed to the hook fasteners 16 by any known means of attachment.

A shock absorbing lanyard 20 as already described can be assembled by first shortening the POY fibers 36 relative to the sheath material. The POY fibers 36 are withdrawn from the sheath 22 and the excess sheath material is gathered or overlapped. To develop a sleek overlap section, in an easy assembly step, while preserving the maximum free length of POY fibers 36 for optimal performance, high modulus ends 44 can be assembled with the POY fibers 36. These high modulus ends 44 are used to bind the top and bottom halves of the sheath material together without binding the POY fibers 36. By doing this, the bound section can be easily pulled within the adjacent tubular section of the sheath 22 as the POY fibers 36 and high modulus ends 44 are extracted. The fibers can be extracted from the side of the webbing, through a hole or at locations where the POY fibers 36 are woven as floats outside of the sheath material. The POY fibers 36 can also be extracted by pulling them from a cut end of the sheath 22 where the POY fibers 36 are accessible in the center. Other mechanisms are also possible for reducing the POY length. Some methods involve feeding the excess POY back into the sheath 22. Alternatively, with elastic woven into the sheath 22, POY fibers 36 can be extracted simply by pulling the webbing tight, holding the POY fibers 36 and cutting the sheath material.

Once the length of the POY fibers 36 has been reduced, the excess sheath material is fixed in place with a rip stitch 40 or other technique of binding the excess sheath material to itself or in some cases the POY fibers. As explained earlier, rip stitch 40 or similar binding is used to establish the minimum deployment/activation force of the lanyard as required by the ANSI Z359.1 Standard. This binding also contributes to fall-arrest. The lanyard material assembled as described here can now be affixed to hooks, anchor points, loops, deployment indicators, or any number of items by techniques suitable for the type of webbing used.

Figure 7:
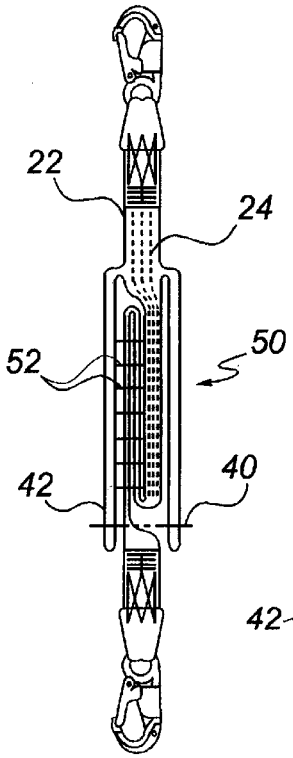
FIG. 7 shows a cross-sectional view of a first embodiment of a hybrid lanyard.

Additionally, a hybrid lanyard 50, can be made which uses multiple rip stitches 52 in addition to the elongation properties of the POY fibers. The force of breaking the multiple rip stitches 52 can serve to prevent high peak forces or increase fall resistance during initial deployment. In a first hybrid embodiment illustrated in FIG. 7, the multiple rip stitching 52 works in series with the POY elongation. The intent is to limit the peak force of fall arrest to the force required to break the rip stitches. The multiple rip stitching 52 would be designed to tear at a force greater than the average force of elongating the POY fibers. At this force level, multiple rip stitching prevents further POY elongation, and the associated high forces, by overtaking the roll of energy absorption.

Figure 8A:
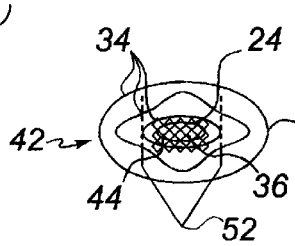
FIG. 8A shows a cross-sectional end view of the hybrid lanyard of FIG. 8.taken through line 8—8.
Figure 8:
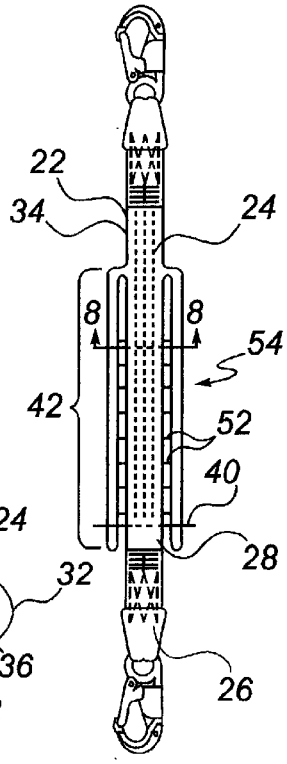
FIG. 8 shows a cross-sectional view of a second embodiment of a hybrid lanyard.

In a second hybrid embodiment illustrated in FIGS. 8 and 8A, multiple rip stitching 52 works in parallel with the POY elongation. The second embodiment of a hybrid lanyard 54 shows the rip stitching configured to exert resistance immediately following shock absorber activation, when POY elongation forces are still relatively low. Thus the force versus elongation response of the lanyard can more closely follow the ideal response of a constant force over the maximum fall arrest distance allowable.

Figure 9:
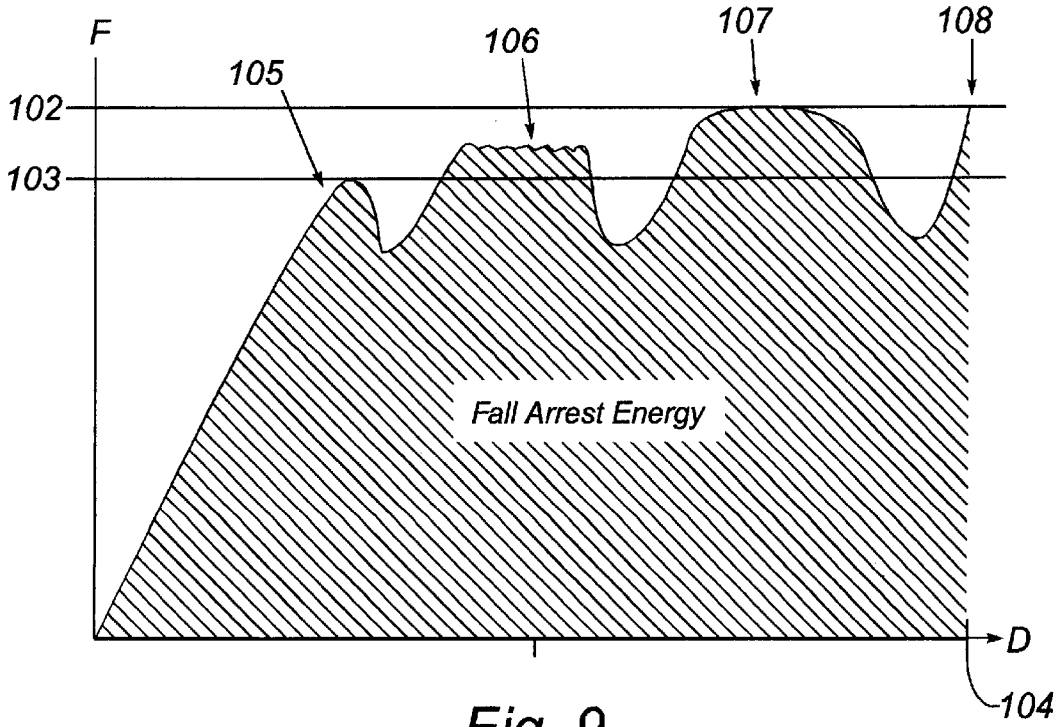
FIG. 9 shows a force versus distance diagram of the performance of the lanyard of the present invention.
Figure 3:
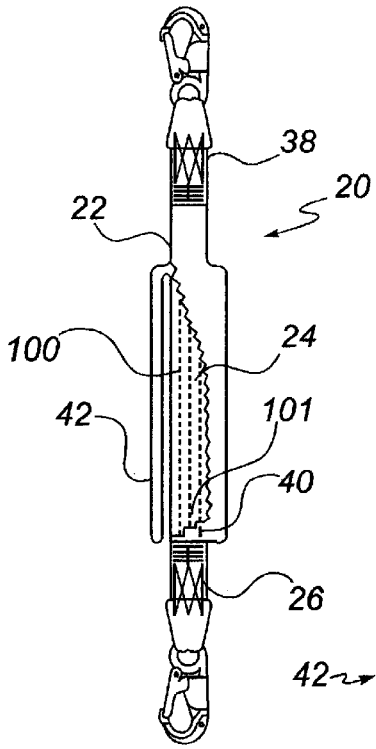
FIG. 3 shows a partial cross-sectional view of the lanyard of FIG. 2.
Figure 4A:
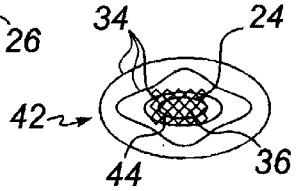
FIG. 4A shows a cross-sectional end view of the lanyard of FIG. 4 taken through line 4—4.
Figure 4:
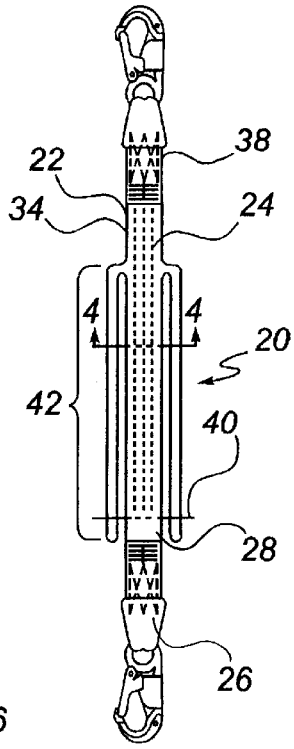
FIG. 4 shows a full cross-sectional view of the lanyard of FIG. 2.
Figure 5:
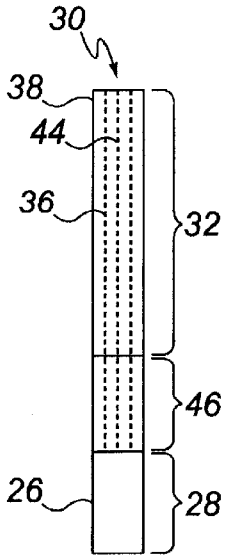
FIG. 5 shows the unassembled woven portion of the lanyard of FIG. 2.
Figure 6:
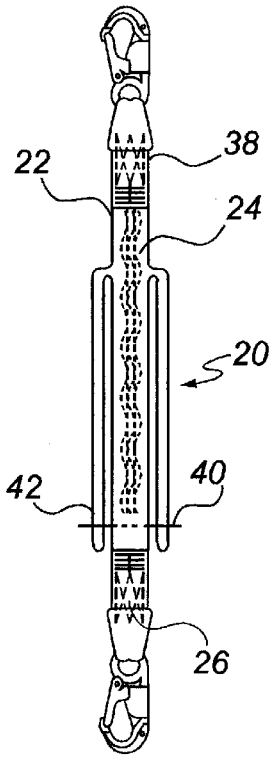
FIG. 6 shows a cross-sectional view of an alternative embodiment of the present invention utilizing elastic in the core.

FIG. 9 illustrates a force versus distance graph depicting the fall arrest energy of a shock absorbing lanyard of the present invention through the peak and activation forces of rip stitching, optional high modulus ends, optional multiple rip stitching, POY fibers and the sheath material.

Figure 10:
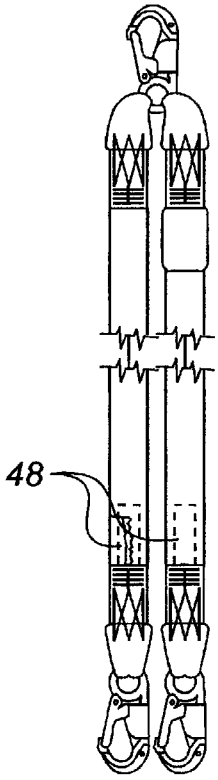
FIG. 10 shows a lanyard of the present invention in a twin leg configuration including warning labels.
Figure 11:
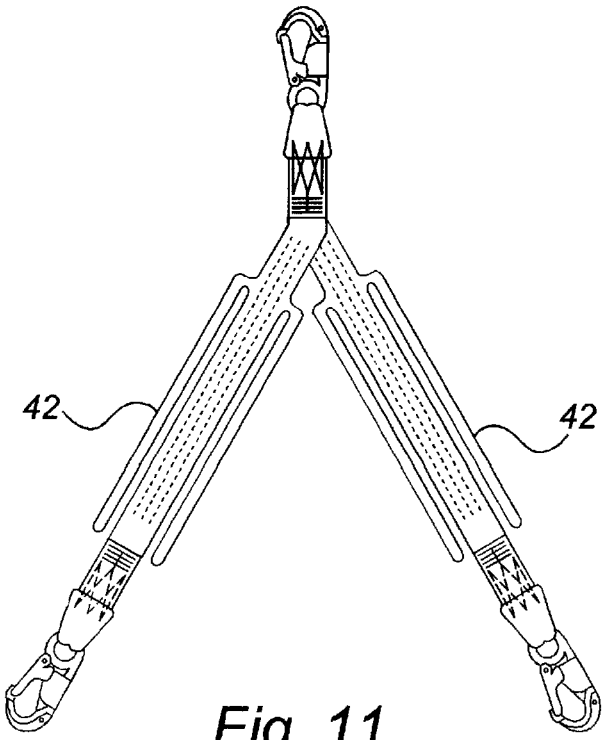
FIG. 11 is a cross-sectional view of a first embodiment of a twin leg lanyard of the present invention.
Figure 12:
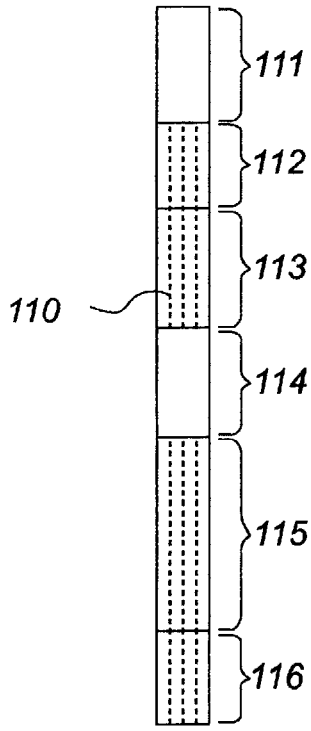
FIG. 12 shows the unassembled woven portion of the twin leg lanyard of FIG. 11.
Figure 13:
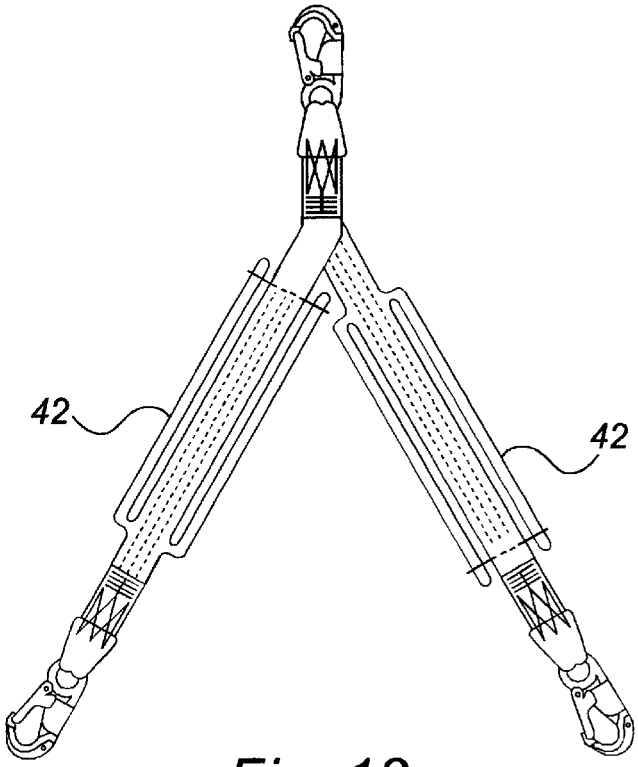
FIG. 13 is a cross-sectional view of a second embodiment of a twin leg lanyard of the present invention.
Figure 14:
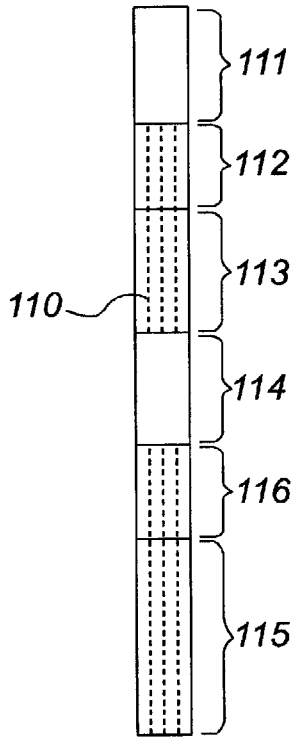
FIG. 14 shows the unassembled woven portion of the twin leg lanyard of FIG. 13.
Figure 15:
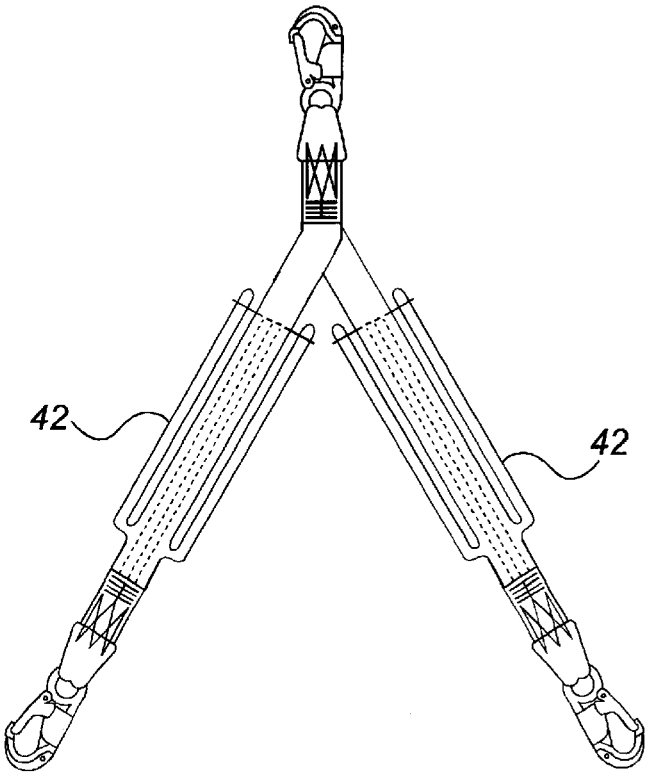
FIG. 15 is a cross-sectional view of a third embodiment of a twin leg lanyard of the present invention.
Figure 16:
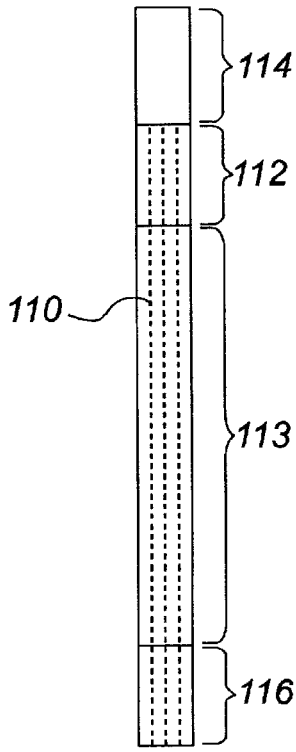
FIG. 16 shows the unassembled woven portion of the twin leg lanyard of FIG. 15.

A multiple leg version of the lanyard of the present invention can be constructed by simply assembling separate shock absorbing lanyards, on one end, to the same connector as shown in FIG. 10. A twin leg lanyard can be assembled this way or from a continuous piece of webbing as shown in FIGS. 11–16. The overlapped or gathered sections of sheath material can be located anywhere along the lanyard legs and there need not be any consistency between the legs. The overlapping sheath 42 can also be at the distal ends of the legs, with the web section having woven POY fibers common to both legs and affixed at the center connector as shown in FIGS. 11–12. Additionally, the sheath material and woven POY sections of each leg can be oriented opposite to one another where a woven POY section of one leg is affixed to the sheath section of the other leg at the common connector as shown in FIGS. 13–14. Finally, the sheath material of both legs can be one continuous piece, affixed at the common connector as shown in FIGS. 15–16.

Figure 17:
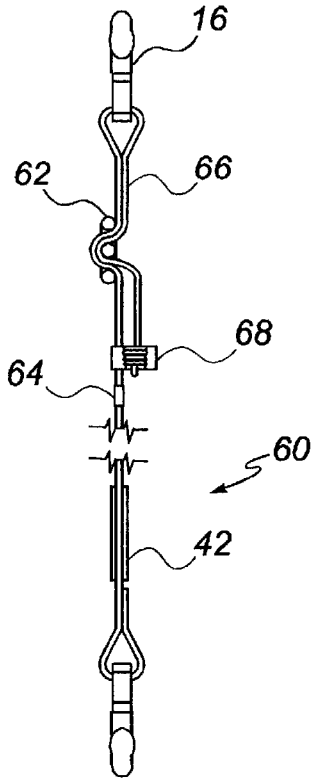
FIG. 17 shows a side view of a lanyard length adjuster of the present invention.

Also, an adjustable length lanyard 60 of the present invention can be constructed by numerous techniques. One such embodiment is shown in FIG. 17. Since it is desirable to maximize the free POY length of the shock absorbing lanyard, the end of the lanyard with interlocked POY fibers 36 may not provide sufficient length for the desired adjustment range. Thus in the illustration, the end 66 of the lanyard 60 with free-floating POY fibers 36 in the sheath 22 is chosen for the adjustment mechanism. A three-bar adjuster 62 secures the adjusted length.of the lanyard 60 and one end point for POY elongation in case of fall arrest. There is a minimum amount of free-floating POY fibers necessary.for safe fall-arrest forces. Thus a limit stop 64 is placed to prevent location of the three bar adjuster 62 beyond the point necessary to maintain the minimum free-floating POY length. A keeper 68 is provided at the stitched end of the webbing. The limit stop 64 is necessary to maintain the minimum free-floating POY length necessary to comply with existing fall-arrest standards, that do not recognize reduced fall forces associated with reduced lanyard length. Even though not shown in the illustration, unfolded/ungathered POY material can also be used for an adjustable length lanyard. This can be done by weaving elastic yarns into the sheath.

Figure 18:
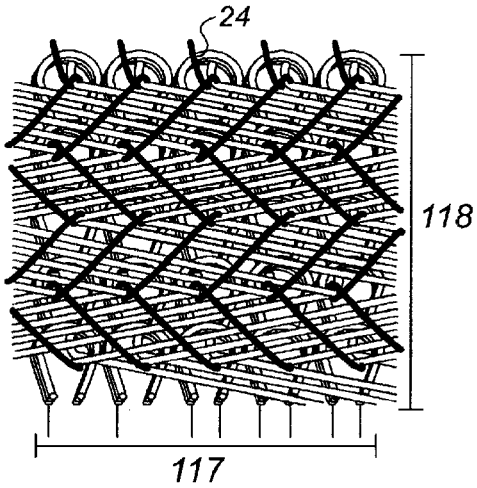
FIG. 18 shows an example of a sharkskin knit pattern that allows some material elongation before POY engagement.
Figure 19:
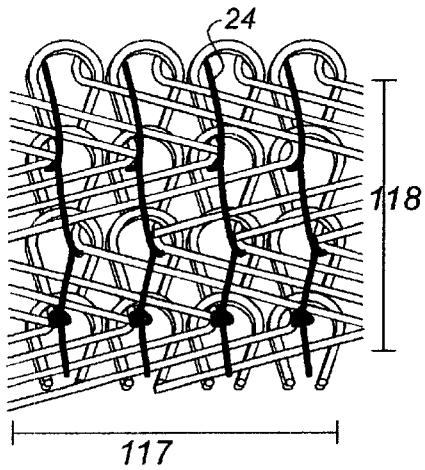
FIG. 19 shows an example of a queenscord knit pattern-that allows some material elongation before POY engagement.
Figure 20:
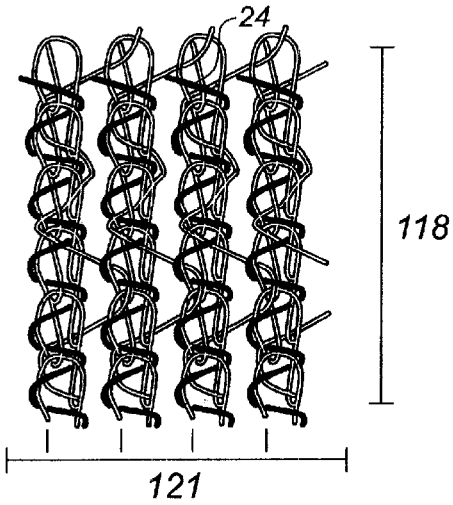
FIG. 20 shows an example of a knit pattern with the POY material inlaid.

FIGS. 18–20 show several examples of knit configurations that could be used in the present invention. The black yarns 24. represent the POY fibers. High modulus ends and elastic ends could be included among the POY fibers to set the activation energy of the product and resting product length, respectively.

Figure 21:
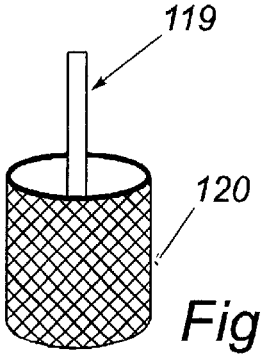
FIG. 21 shows an example of a "Maypole" braided material.
Figure 22:
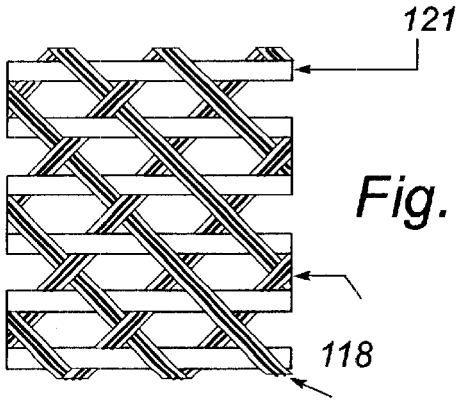
FIG. 22 shows an example of a triaxial braided material.

FIGS. 21–22 show two examples of braided configurations that could be used in the present invention. The white yarns 24 represent the POY fibers. High modulus ends and elastic ends could be included among the POY fibers to set the activation energy of the product and resting product length, respectively.

Figure 23A:
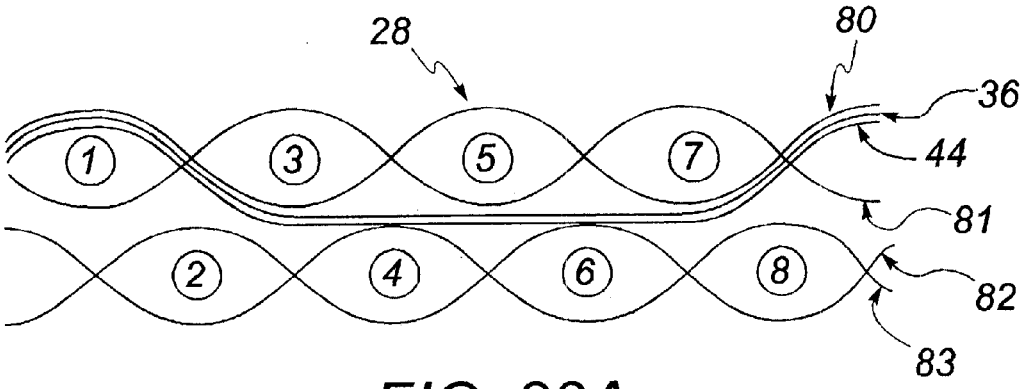
FIGS. 23A–23C show an example of the weave profile used to create the unassembled woven portion shown in FIG. 5.
Figure 23B:
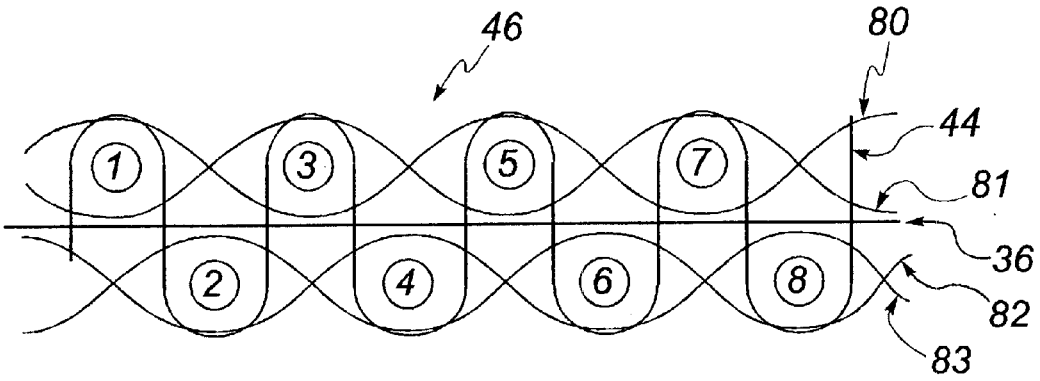
Figure 23C:
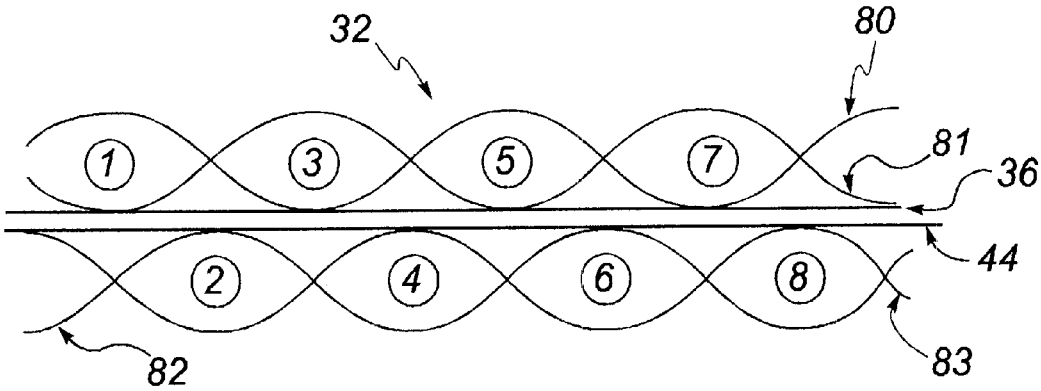

FIGS. 23A–23C show a preferred weave pattern used to create the different sections of webbing used in the lanyard of the present invention wherein numbers 1–8 represent picks which run perpendicular to the warp. A plurality of high strength ends 80, 81, 82 and 83 are woven together with POY fibers 36 and high modulus ends 44.

Figure 24A:
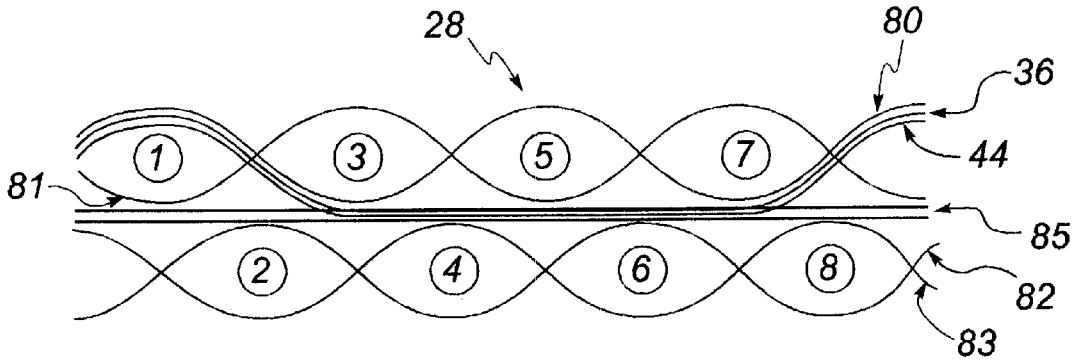
FIGS. 24A–24C show an example of the weave profile used to create a webbing with elastic in the core.
Figure 24B:
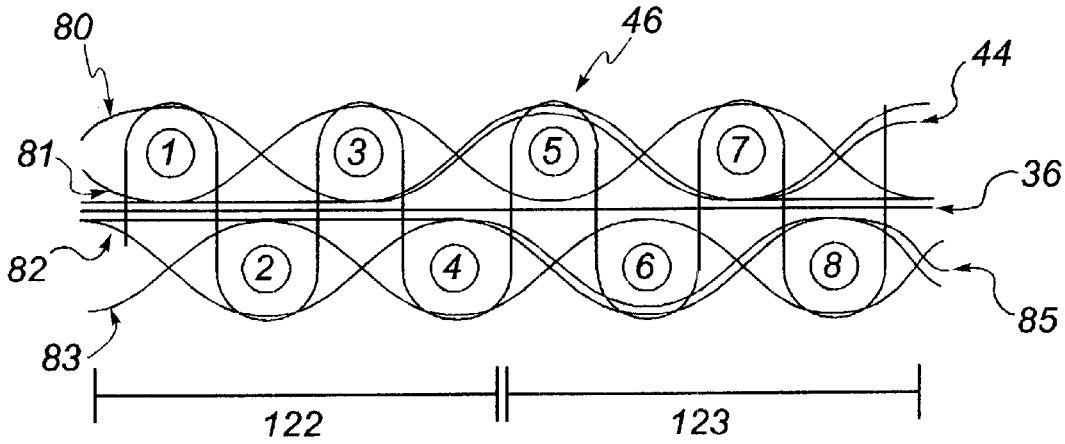
Figure 24C:
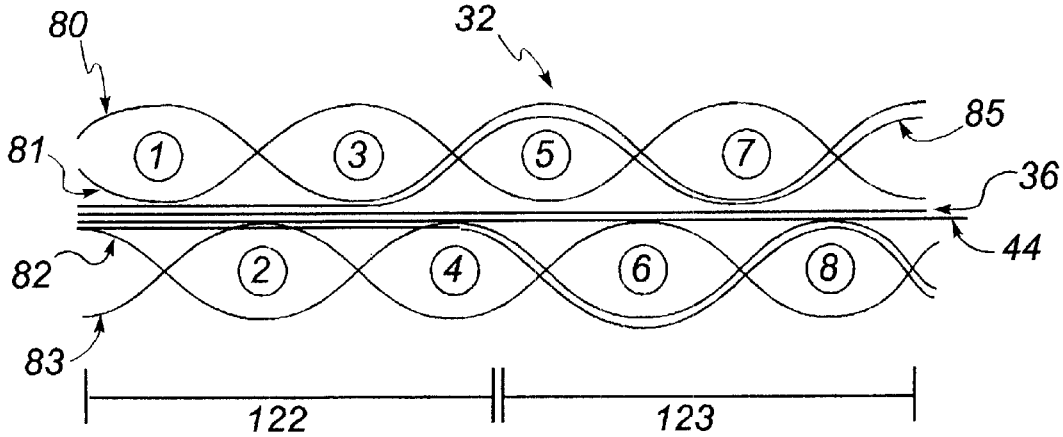

FIGS. 24A–C show a preferred weave pattern used to create the different sections of webbing used in an embodiment of the lanyard of the present invention further comprising an elastic material in the core wherein numbers 1–8 represent picks which run perpendicular to the warp. A plurality of high strength ends 80, 81, 82 and 83 are woven together with POY fibers 36, high modulus ends 44 and elastic 85.

Figure 25A:
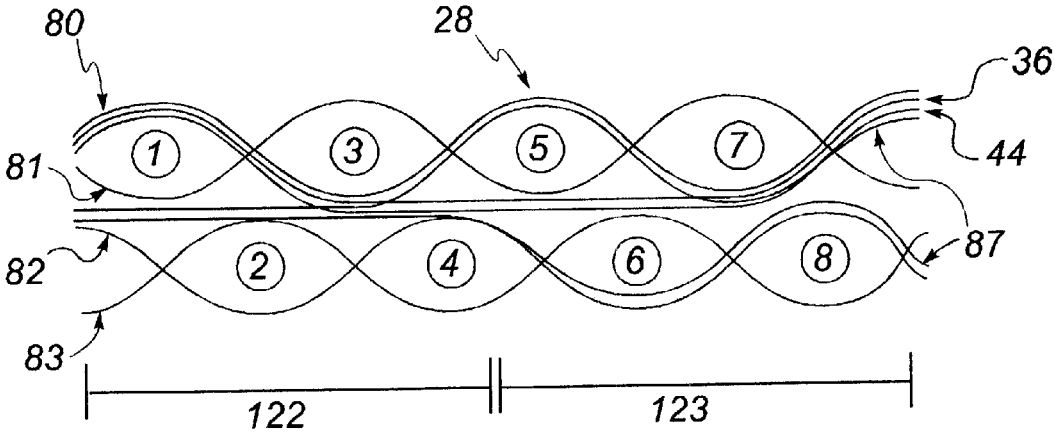
FIGS. 25A–25B show an example of the weave profile used to create a webbing with elastic in the sheath.
Figure 25B:
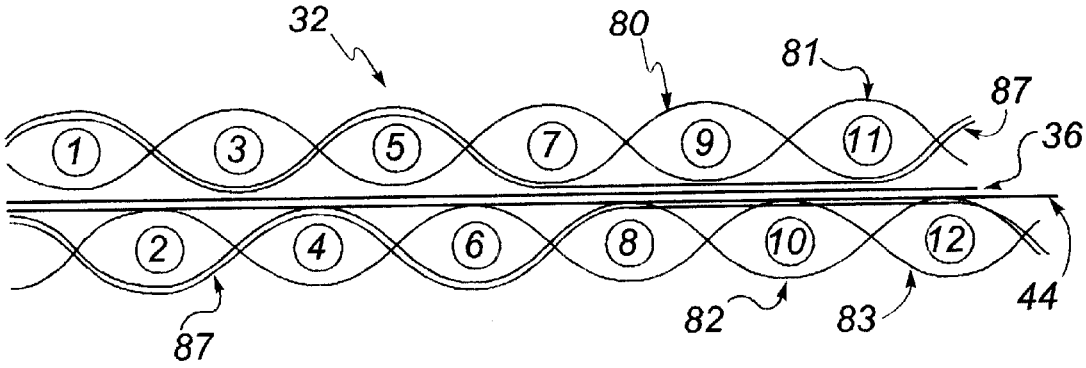

FIGS. 25A–25B show a preferred weave pattern used to create the different sections of webbing used in an embodiment of the lanyard of the present invention further comprising an elastic material in the sheath wherein numbers 1–8 represent picks which run perpendicular to the warp. A plurality of high strength ends 80, 81, 82 and 83 are woven together with POY fibers 36, high modulus ends 44 and elastic 87.

If not otherwise stated herein, it may be assumed that all components and/or processes described heretofore may, if appropriate, be considered to be interchangeable with similar components and/or processes disclosed elsewhere in the specification, unless an indication is made to the contrary. If not otherwise stated herein, any and all patents, patent publications, articles and other printed publications discussed or mentioned herein are hereby incorporated by reference as if set forth in their entirety herein. It should be appreciated that the apparatus and methods of the present invention may be configured and conducted as appropriate for the application. The embodiments described above are to be considered in all respects only as illustrative and not restrictive. The scope of the invention is defined by the following claims rather than by the foregoing description. All changes, which come within the meaning and range of equivalency of the claims, are to be embraced within their scope.

TABLE 1

| | |
|---|---|
| 100: | Cut-away view showing center section of webbing (FIG. 3) |
| 101: | Woven POY ends (FIG. 3) |
| 102: | Peak force (FIG. 9) |
| 104: | Peak fall-arrest distance (FIG. 9) |
| 105: | Rip stitch and high-modulus ends (optional) (FIG. 9) |
| 106: | Multiple rip stitch (optional) (FIG. 9) |
| 107: | POY (FIG. 9) |
| 108: | Sheath (FIG. 9) |
| 109: | Unassigned |
| 110: | POY and high modulus ends (high modulus ends optional) (FIGS. 12, 14 & 16) |
| 111: | POY integrated section 1 (FIGS. 12 & 14) |
| 112: | High modulus binder section 1 (optional) (FIGS. 12, 14 & 16) |
| 113: | Sheath section 1 (FIGS. 12, 14 & 16) |
| 114: | POY integrated sedion 2 (FIGS. 12, 14, & 16) |
| 115: | Sheath section 2 (FIGS. 12 & 14) |
| 116: | High modulus binder section 2 (optional) (FIGS. 12, 14 & 16) |
| 117: | POY and high-modulus (optional ends) (FIGS. 18 & 19) |
| 118: | Residual strength ends (FIGS. 18–20 & 22) |
| 119: | POY and high-modulus (optional) ends form the core (FIGS. 21) |
| 120: | Braided Sheath (FIG. 21) |
| 121: | POY, elastic (optional), and high-modulus (optional) ends (FIGS. 20 & 22) |
| 122: | Repeat pattern (FIGS. 24B, 24C and 25A) |
| 123: | Repeat at end of section (FIGS. 24B, 24C and 25A) |

What is claimed is:

1. A shock absorbing lanyard that will deploy in response to a force of between 450 lbs. and 900 lbs., the lanyard comprising;

a one piece webbing including partially oriented yarn fibers and high strength yarn fibers, the partially oriented yarn fibers being adapted to elongate under the force applied to the shock absorbing lanyard and to absorb energy;

a first section of the one piece webbing, the partially oriented yarn fibers and the high strength yarn fibers being integrally assembled in the first section by one of weaving, knitting and braiding; and a second section of the one piece webbing, the partially oriented yarn fibers and the high strength yarn fibers being separately assembled in the second section, the high strength yarn fibers forming a sheath around the partially oriented yarn fibers in the second section.

2. The shock absorbing lanyard of claim 1 wherein the partially oriented yarn fibers form a core.

3. The shock absorbing lanyard of claim 2 wherein the sheath is longer than the core and is overlapped about itself surrounding the core forming an overlapping sheath.

4. The shock absorbing lanyard of claim 3, wherein the overlapping sheath is secured with a rip stitch.

5. The shock absorbing lanyard of claim 4 further comprising a deployment indicator for indicating when the sheath has been extended.

6. The shock absorbing lanyard of claim 5 wherein the deployment indicator is a flag secured by the rip stitch.

7. The shock absorbing lanyard of claim 2 further comprising high modulus ends integrally connected among the partially oriented yarn fibers in the first section and in the core.

8. The shock absorbing lanyard of claim 7 further comprising a high modulus binder portion disposed between the first section and the second section.

9. The shock absorbing lanyard of claim 2 further comprising a means for adjusting the length of the lanyard.

10. The shock absorbing lanyard of claim 9 wherein the means for adjusting the length of the lanyard comprises a three-bar adjuster securing the webbing.

11. The shock absorbing lanyard of claim 4, further comprising multiple rip stitches securing a portion of the sheath for resistance operation in series with partially oriented yarn elongation forces.

12. The shock absorbing lanyard of claim 4, further comprising multiple rip stitches securing the overlapping sheath for resistance operation in parallel with partially oriented yarn elongation forces.

13. A multi-leg shock-absorbing lanyard that will deploy in response to a force of between 450 lbs. and 900 lbs., the multi-leg lanyard comprising:

a plurality of legs, each leg comprising a one-piece webbing including partially oriented yarn fibers and high-strength yarn fibers, the partially oriented yarn fibers being adapted to elongate under the force applied to each leg of the multi-leg shock absorbing lanyard and to absorb energy;

a first section of the one piece webbing, the partially oriented yarn fibers and the high strength yarn fibers being integrally assembled in the first section by one of weaving, knitting and braiding; and a second section of the one piece webbing, the partially oriented yarn fibers and the high strength yarn fibers being separately assembled in the second section, the high strength yarn fibers forming a sheath around the partially oriented yarn fibers in the second section.

14. The multi-leg shock absorbing lanyard of claim 13 wherein the partially oriented yarn fibers form at least one core.

15. The multi-leg shock absorbing lanyard of claim 14 wherein the sheath is longer than the at least one core and is overlapped about itself surrounding the at least one core and forming at least one overlapping sheath.

16. A harness including a shock absorbing lanyard that will deploy in response to a force of between 450 lbs. and 900 lbs., the shock absorbing lanyard comprising;

a one piece webbing including partially oriented yarn fibers and high strength yarn fibers, the partially oriented yarn fibers being adapted to elongate under the force applied to the shock absorbing lanyard and to absorb energy;

a first section of the one piece webbing, the partially oriented yarn fibers and the high strength yarn fibers being integrally assembled in the first section by one of weaving, knitting and braiding; and a second section of the one piece webbing, the partially oriented yarn fibers and the high strength yarn fibers being separately assembled in the second section, the high strength yarn fibers forming a sheath around the partially oriented yarn fibers in the second section.

* * * * *